US006427971B1

(12) United States Patent
Kawabe et al.

(10) Patent No.: US 6,427,971 B1
(45) Date of Patent: Aug. 6, 2002

(54) SYSTEM FOR CONTROLLING ELECTROMAGNETICALLY ACTUATED VALVE

(75) Inventors: Taketoshi Kawabe, Yokohama; Kouichiro Yonekura; Ikuhiro Taniguchi, both of Kanagawa, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/465,680

(22) Filed: Dec. 17, 1999

(30) Foreign Application Priority Data

Dec. 17, 1998 (JP) ..... 10-359591

(51) Int. Cl.[7] ..... F16K 31/02

(52) U.S. Cl. ..... 251/129.04; 251/129.18; 137/486

(58) Field of Search ..... 251/129.04, 129.05, 251/129.18; 137/486; 364/162, 183; 318/610

(56) References Cited

U.S. PATENT DOCUMENTS 3,699,989 A * 10/1972 O'Connor et al. ..... 251/129.05
4,354,224 A * 10/1982 Sato ..... 364/183
4,638,837 A * 1/1987 Buike et al. ..... 251/129.05
4,738,283 A * 4/1988 Shirai et al. ..... 137/624.11
4,957,074 A 9/1990 Weissler, II et al.
5,059,880 A * 10/1991 Hiroio ..... 318/610
5,335,165 A * 8/1994 Shinskey ..... 364/162
5,371,670 A * 12/1994 Lurie ..... 364/162
6,152,108 A * 11/2000 Adachi et al. ..... 123/399
6,256,566 B1 * 7/2001 Kamiya et al. ..... 701/50

FOREIGN PATENT DOCUMENTS

JP 10-205314 8/1998
JP 10-220622 8/1998

* cited by examiner

*Primary Examiner*—William C. Doerrler
*Assistant Examiner*—David A Bonderer
(74) *Attorney, Agent, or Firm*—Foley & Lardner

(57) ABSTRACT

An electromagnetically actuated valve includes generally an electromagnet, an armature member driven by the electromagnet and a valve driven by the armature member. The armature member and the valve are movable together to constitute a movable unit. For controlling the electromagnetically actuated valve, there is provided a control system which comprises a position detecting unit that detects a position of the movable unit; a speed detecting unit that detects a moving speed of the movable unit; a target speed deriving section that derives a target speed of the movable unit by processing the position of the movable unit; a comparator section that compares the speed detected by the speed detecting unit with the target speed derived by the target speed deriving section; and a control section that, in accordance with the result of the comparison by the comparator section, controls the electromagnet.

15 Claims, 6 Drawing Sheets

SYSTEM FOR CONTROLLING ELECTROMAGNETICALLY ACTUATED VALVE

BACKGROUND OF THE INVENTION

1. Field of the Invention

The present invention relates in general to a valve operating system, and more particularly to a system for controlling an electromagnetically actuated valve of an internal combustion engine. More specifically, the present invention is concerned with a control system for controlling the electromagnetically actuated valve in such a manner as to reduce or minimize a noise inevitably produced by an electromagnetic actuator section of the valve.

2. Description of the Prior Art

For actuating intake and/or exhaust valves of an internal combustion engine, electromagnetic actuators have been hitherto proposed and put into practical use as a substitute for conventionally used cam type actuators. Due to one nature of such. electromagnetic actuators, the open/close timing of the valves is accurately and easily controlled, and thus, usage of such actuators in the engine brings about marked improvement in both engine output and fuel saving. However, due to another nature of such actuators, non-negligible noise tends to be produced under operation, which is caused by collision of an armature of the actuator against electromagnets of the same. For reducing or minimizing such noise, various attempts have been made, some of which are described in Laid-open Japanese Patent Applications 10-205314 and 10-220622. For such noise reduction, these publications propose a unique shape of the electromagnets and avoidance of collision between the armature and each of the electromagnets by producing a larger magnetic force at a certain time.

SUMMARY OF THE INVENTION

It is an object of the present invention to provide a control system for controlling an electromagnetically actuated valve, which can lower or at least minimize a noise inevitably produced in an electromagnetic actuator.

According to a first aspect of the present invention, there is provided a control system for controlling an electromagnetically actuated valve that includes an electromagnet, an armature member driven by the electromagnet and a valve driven by the armature member. The armature member and the valve are movable together to constitute a movable unit. The control system comprises a position detecting unit that detects a position of the movable unit; a speed detecting unit that detects a moving speed of the movable unit; a target speed deriving section that derives a target speed of the movable unit by processing the position of the movable unit; a comparator section that compares the speed detected by the speed detecting unit with the target speed derived by the target speed deriving section; and a control section that, in accordance with the result of the comparison by the comparator section, controls the electromagnet.

According to a second aspect of the present invention, there is provided a method for controlling an electromagnetically actuated valve including an electromagnet, an armature member driven by the electromagnet and a valve driven by said armature member. The armature member and the valve are movable together to constitute a movable unit. The method comprises detecting a position of the movable unit; detecting a moving speed of the movable unit; deriving a target speed of the movable unit by processing the position of the movable unit; comparing the detected speed with the derived target speed; and controlling the electromagnet in accordance with the result of the comparison.

BRIEF DESCRIPTION OF THE DRAWINGS

FIGS. 5A and 5B are graphs showing a target speed of a valve, wherein FIG. 5A shows the target speed using the position as a function and FIG. 5B shows the target speed using a time as a function.

DETAILED DESCRIPTION OF THE INVENTION

Figure 2:
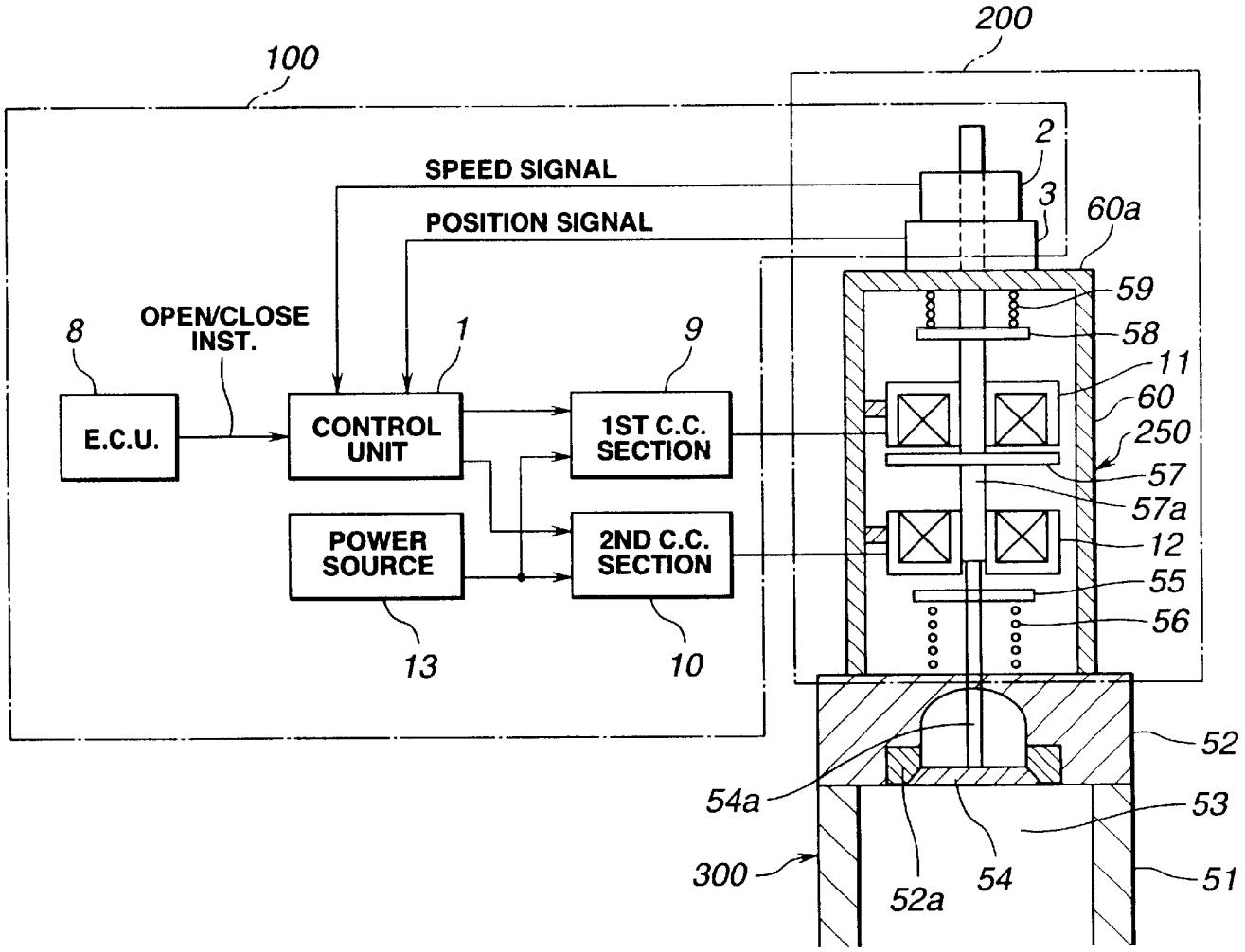
FIG. 2 is a schematic view of the electromagnetically actuated valve to which the control system of the first embodiment of the present invention is practically applied.

Referring to FIG. 2, there is schematically shown a control system 100 of a first embodiment of the present invention, which is practically applied to an electromagnetically actuated valve 200 of an automotive internal combustion engine 300.

The internal combustion engine 300 shown in the drawing comprises a cylinder block 51. A cylinder head 52 is mounted on the cylinder block 51 to define a combustion chamber 53 in an upper part of an interior of the cylinder block 51. A piston (not shown) is slidably and operatively disposed in the interior of the cylinder block 51. The cylinder head 52 is equipped with intake and exhaust valves 54. The valve 54 really illustrated in the drawing may be either an intake valve or an exhaust valve. For ease of description, the illustrated valve 54 will be referred to an intake valve.

The intake valve 54 has a valve stem 54*a* which extends upward to an outside of the cylinder head 52 for the reason which will become apparent from the following.

Mounted on the cylinder head 52 is an electromagnetic actuator 250 which comprises a housing 60 into which the valve stem 54*a* of the valve 54 projects from the below. An upper portion of the valve stem 54*a* is equipped with a spring retainer 55. Compressed between the spring retainer 55 and the cylinder head 52 is a so-called valve closing coil spring 56 for biasing the valve 54 in a valve closing direction, that is, in a direction to close an intake port. The intake port is rimmed by a valve seat 52*a*, as shown.

Within the housing 60, two, that is, so-called valve closing and opening electromagnets 11 and 12 are disposed, which are coaxially and immovably arranged keeping a given distance therebetween. Between these two electromagnets 11 and 12, there is movably arranged an armature 57 which is made of a magnetic material. The armature 57 is provided with a stem 57*a* which extends axially in the housing 60 through center portions of the two electromagnets 11 and 12, as shown.

A lower end of the stem 57*a* is in contact with an upper end of the valve stem 54*a*, and an upper end of the stem 57*a* passes through an upper wall 60*a* of the housing 60. Near the upper wall 60*a* of the housing 60, a spring retainer 58 is fixed to the stem 57*a* and a so-called valve opening coil spring 59 is compressed between the spring retainer 58 and the upper wall 60*a* for biasing the intake valve 54 in a valve opening direction, that is, in a direction to open the intake port rimmed by the valve seat 52*a*.

The control system 100 comprises a speed sensor 2 and a position sensor 3 which are disposed on the upper wall 60*a* of the housing 60 to sense the moving speed and the position of the armature 57, respectively.

Information signals from these speed and position sensors 2 and 3 are led to a control unit 1. Denoted by numeral 8 is an engine control unit 8 (ECU) which issues a valve open/close instruction signal directed to the control unit 1. Processing the information signals from the speed and position sensors 2 and 3 and the instruction signal from the engine control unit 8, the control unit 1 issues an instruction signal to both a first current control section 9 for the valve closing electromagnet 11 and a second current control section 10 for the valve opening electromagnet 12. The instruction signal from the control unit 1 represents a degree of target current.

In accordance with the degree of the target current issued from the control unit 1, each current control section 9 or 10 carries out a PWM control (pulse width modulation control) to force a power source 13 to feed the electromagnet 11 or 12 with a corresponding electric power. With this, the electromagnetic force produced by the electromagnet 11 or 12 is controlled in accordance with the degree of the target current.

Figure 1:
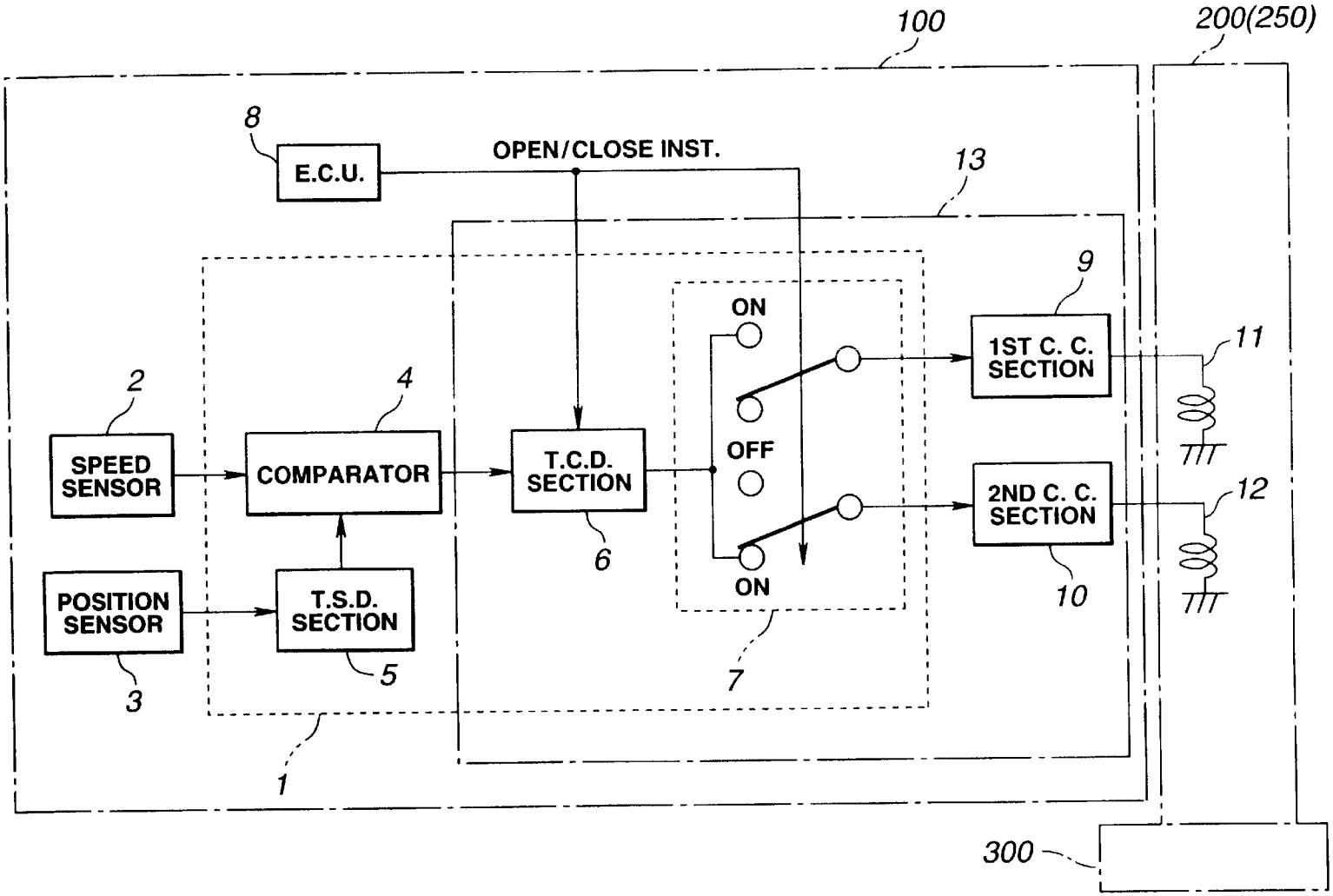
FIG. 1 is a block diagram of a control system for controlling an electromagnetically actuated valve of an internal combustion engine, which is a first embodiment of the present invention.

Referring to FIG. 1, there is shown the detail of the control unit 1 employed in the control system 100.

The control unit 1 comprises a comparator section 4, a target speed deriving section 5, a target current deriving section 6 and a switch section 7. Processing the armature position representing signal issued from the position sensor 3, the target speed deriving section 5 derives a target speed of the armature 57. The existing speed representing signal issued from the speed sensor 2 and the target speed representing signal issued from the target speed deriving section 5 are compared by the comparator section 4. Based on the comparison, the target current deriving section 6 derives a target current which is to be selectively applied to either the valve closing electromagnet 11 or the valve opening electromagnet 12. For the selection, the switch section 7 is arranged between the target current deriving section 6 and each of the current control sections 9 and 10, as shown. The valve open and close instruction signals issued from the engine control unit 8 are applied to both the target current deriving section 6 and the switch section 7.

In the following, operation of the control system 100 will be described with reference to FIG. 2.

The armature 57 is suspended by the valve closing and opening coil springs 56 and 59 through the armature stem 57*a*. Thus, when the valve closing and opening electromagnets 11 and 12 are kept deenergized, the armature 57 takes a rest position between the two electromagnets 11 and 12. The rest position of the armature 57 is determined based on respective spring constants of the two coil springs 56 and 59.

Now, in the spring/mass system consisting of a spring part including the two coil springs 56 and 59 and a mass part including the armature 57, the stem 57*a* and the intake valve 54, the natural frequency "fo" is represented by the following equation:

$$fo=\sqrt{(K/m)} \quad (1)$$

wherein:

k: combined spring constant of the spring part, m: combined inertia mass of the mass part.

At a first stage of an initial operation before starting the engine, the two electromagnets 11 and 12 are alternatively energized at a period corresponding to the natural frequency "fo". With this, the armature 57 resonates and the amplitude of the resonating armature 57 gradually increases. At a final stage of the initial operation, the armature 57 is attracted to either one of the electromagnets 11 and 12 and the attracting is maintained.

For starting the engine or keeping the engine in operation, the following operation takes place.

That is, for opening the intake valve 54, the valve closing electromagnet 11 becomes deenergized. With this, the armature 57 is shifted downward due to disappearance of the attracting force produced by the electromagnet 11. Such downward shifting of the armature 57 permits the intake valve 54 to slightly open the intake port. When, due to the downward shifting, the armature 57 comes sufficiently close to the valve opening electromagnet 12, the electromagnet 12 becomes energized to promote the downward shifting of the armature 57. With this, the intake valve 54 fully opens the intake port.

During this, the control unit 1 receives, from the position sensor 3 and the speed sensor 2, information on the position and moving speed of the armature 57, and issues to the second current control section 10 an instruction signal so that the moving speed of the armature 57 follows a target moving speed. In accordance with the instruction signal from the control unit 1, the current of the valve opening electromagnet 12 is appropriately controlled and thus the electromagnetic force produced by the same is appropriately controlled. As a result of this control, the armature 57 is controlled to contact the valve opening electromagnet 12 at a speed below a predetermined degree (for example, 0.1 m/sec.) and thus stop at the contacting position, or stop at a position away from the valve opening electromagnet 12 by several hundred microns.

Figure 3:
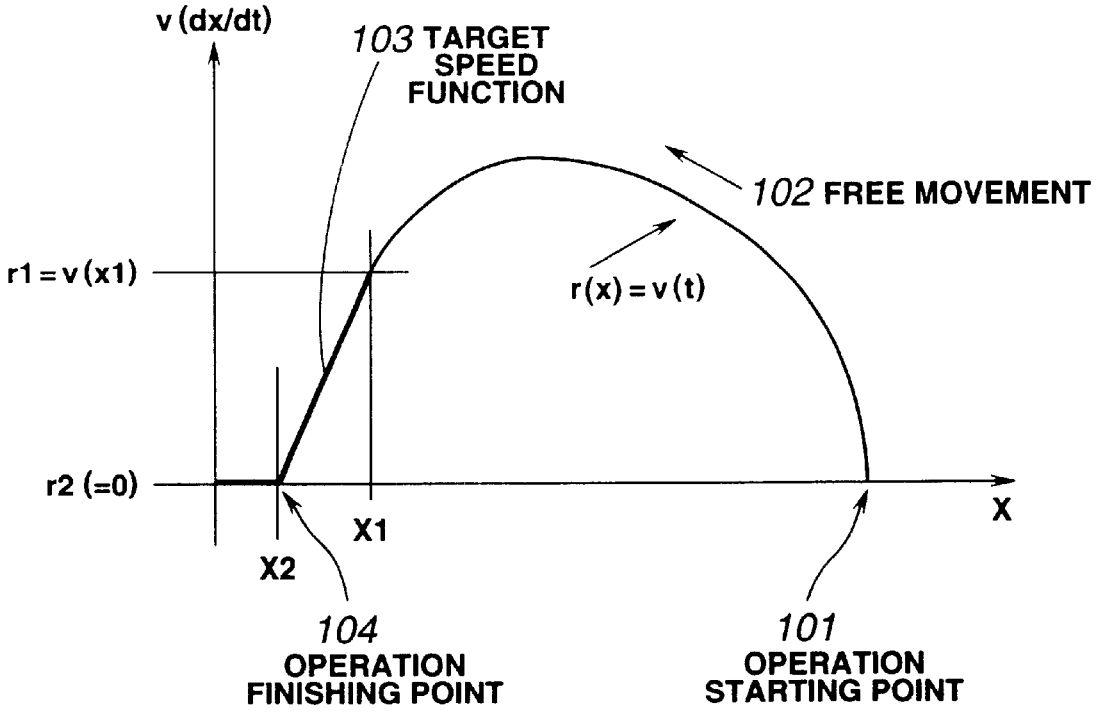
FIG. 3 is a graph showing a locus described by an armature with respect to a position and a moving speed of the same, which depicts the way for finding a target speed function used in the invention.

FIG. 3 is a graph showing a locus described by the armature 57 with respect to the position and the speed of the same. In the present invention, the armature 57 moves along the locus of FIG. 3. In the graph, X-coordinate represents a distance "x" (gap) between the armature 57 and the valve opening electromagnet 12, and Y-coordinate represents a moving speed "v" (=dx/dt) of the armature 57. As is seen from this graph, the armature 57 starts from an operation starting point 101 and moves toward the point "x1" along a free movement locus 102. When the armature 57 arrives the point "x1" (that is, x=x1), the speed control for the armature 57 starts and thus thereafter the armature 57 is forced to move along a target speed function 103 that includes the speed as a function.

The target speed function 103 is so determined that a target speed "r1" at the position "x=x1" matches with an existing speed "v(x1)" actually detected by the speed sensor 2. As shown in the graph, while being lowered in speed due to the speed control, the armature 57 thereafter moves toward to an operation finishing point 104, that is, the point "x=x2". When the armature 57 arrives the point "x=x2 ", the target speed of the armature 57 shows a value "r2" that is 0 (zero), that is, the electromagnetic force of the electromagnet is so controlled as to stop the armature 57 at the operation finishing point 104. It is to be noted that a target speed of the armature 57 other than the points "x1" and "x2" can be found from a straight line that is provided by subjecting the target speeds "r1" and " r2" to interpolation or extrapolation method.

For closing the intake valve 54, the valve opening electromagnet 12 becomes deenergized. Upon this, the armature 57 and the intake valve 54 are moved upward together like a single unit due to force of the coil springs 59 and 56. However, due to an inevitable energy loss originating from a friction force, complete closing of the intake valve 54 is not achieved by only the force of the springs 59 and 56.

Accordingly, when, due to the force of the springs 59 and 56, the armature 57 comes sufficiently close to the valve closing electromagnet 11, the electromagnet 11 is energized to promote the upward shifting of the armature 57. With this, the intake valve 54 assumes its full close position, and then, the armature 57 becomes separated from the intake valve 54 and is moved up toward the valve closing electromagnet 11.

By the above-mentioned operation of the control unit 1, severe collision between the intake valve 54 and the valve seat 52*a* and that between the armature 57 and each of the two electromagnets 11 and 12 are assuredly suppressed. For this control, the control unit 1 processes the information signals issued from the speed and position sensors 2 and 3 and forces the first current control section 9 to appropriately control the current fed to the valve closing electromagnet 11. That is, due to the control by the control unit 1, the armature 57 or the intake valve 54 is controlled to contact the valve closing electromagnet 11 or the valve seat 52*a* at a speed below a predetermined value (for example, 0.1 m/sec.). As is seen from the graph of FIG. 3, when the armature 57 comes to a position (viz., "x2") away from the valve closing electromagnet 11 by several hundred microns, the control unit 1 determines the target speed of the armature 57 to 0 (zero). Thus, the armature 57 is forced to stop at such position without contacting the electromagnet 11. This brings about suppression of collision noise as well as elongation of the life of the valve closing electromagnet 11.

As is seen from FIG. 1, the control unit 1 receives the valve open and close instruction signals from the engine control unit 8 (ECU). If the signal is of the valve open instruction signal, the second current control section 10 is selected by the switch section 7 and a target current derived by the target current deriving section 6 is led to the selected circuit 10, while, if the signal is of the valve close instruction signal, the first current control section 9 is selected by the switch section 7 and a target current of the target current deriving section 6 is led to the selected section 9.

Upon receiving the speed and position representing signals from the speed and position sensors 2 and 3, the target current deriving section 6 devices the target current in the following manner.

The target speed "r" is represented by the following formula:

$$r = \begin{cases} v(t) & (x(t) > x1) \\ r(x) & (x(t) \le x1) \end{cases} \tag{2}$$

wherein:

- x: distance between the armature 57 and the electromagnet 11 or 12, that is derived from the output of the position sensor 3;
- t: time;
- v: speed detected by the speed sensor 2 or value derived by differentiating the distance "x" by time "t"; and
- r (x): target speed function, that is determined at a time "t1" when, with reduction of gap between the armature 57 and the electromagnet 11 or 12, the distance "x" indicates "x1".

It is to be noted that the value "x1" is determined based on a minimum gap that can bring about an effectiveness of the electromagnetic force produced by the electromagnet 11 or 12. Practically, the value "x1" is 1 to 3 mm.

The function "r (x)" is determined in such a way as to satisfy the following condition.

$$r(x1)=r1=v(t1) \tag{3}$$

$$r(x2)=r2 \tag{4}$$

or $$r(x)=r2 \ (x<x2) \tag{5}$$

It is to be noted that "x2" is a second predetermined value, and "r2" is a parameter that sets the collision speed of the armature 57 against the electromagnet 11 or 12. When "r2" is determined 0 (zero) or almost 0 (zero), the collision can be avoided.

If it is designed to collide the armature 57 against the electromagnet 11 or 12 at a speed of 0.05 m/sec., the following fixed values are provided for "x2" and "r2":

$$x2=0,\ r2=0.05\text{m/sec.} \tag{6}$$

Or, if it is designed to stop the armature 57 just before the electromagnet 11 or 12, the following fixed values are provided for "x2" and "r2":

$$x2=200\mu\text{m},\ r2=0 \tag{7}$$

In the range "x2<x<x1", an interpolation method with function values at the time of "x1" and "x2" is used. If, for example, a linear interpolation is used, the following formula is employed:

$$r(x) = \frac{r2 - r1}{x2 - x1}(x - x1) + r1 \tag{8}$$

Of course, interpolation method using quadratic or tertiary curve may be also employable.

As is seen from FIG. 1, the target speed "r(x)" is compared with the detected speed "v" in the comparator section 4, and thus the comparator section 4 issues a comparison signal "(v−r(x))" to the target current deriving section 6. In the section 6, a target current "i*(t)" is derived by using the following formula:

$$i^*(t) = \begin{cases} -k\{v - r(x)\} & (r(x) - v > 0) \\ 0 & (r(x) - v \le 0) \end{cases} \tag{9}$$

It is to be noted that "k" is a constant (viz., feedback gain). Since, in the range "x<x1", r (x) is equal to "v", speed control is not provided.

The target current "i*(t)" is fed through the switch section 7 to the first or second current control section 9 or 10, as a current for energizing the corresponding electromagnet 11 or 12. Under PWM control (pulse width modulation control), the first or second current control section 9 or 10 controls the ON/OFF ratio of current supplied by the power source 13. With this, the current fed to the electromagnet 11 or 12 is controlled and thus the electromagnetic force applied to the armature 57 is controlled thereby adjusting the moving speed of the armature 57.

Figure 4:
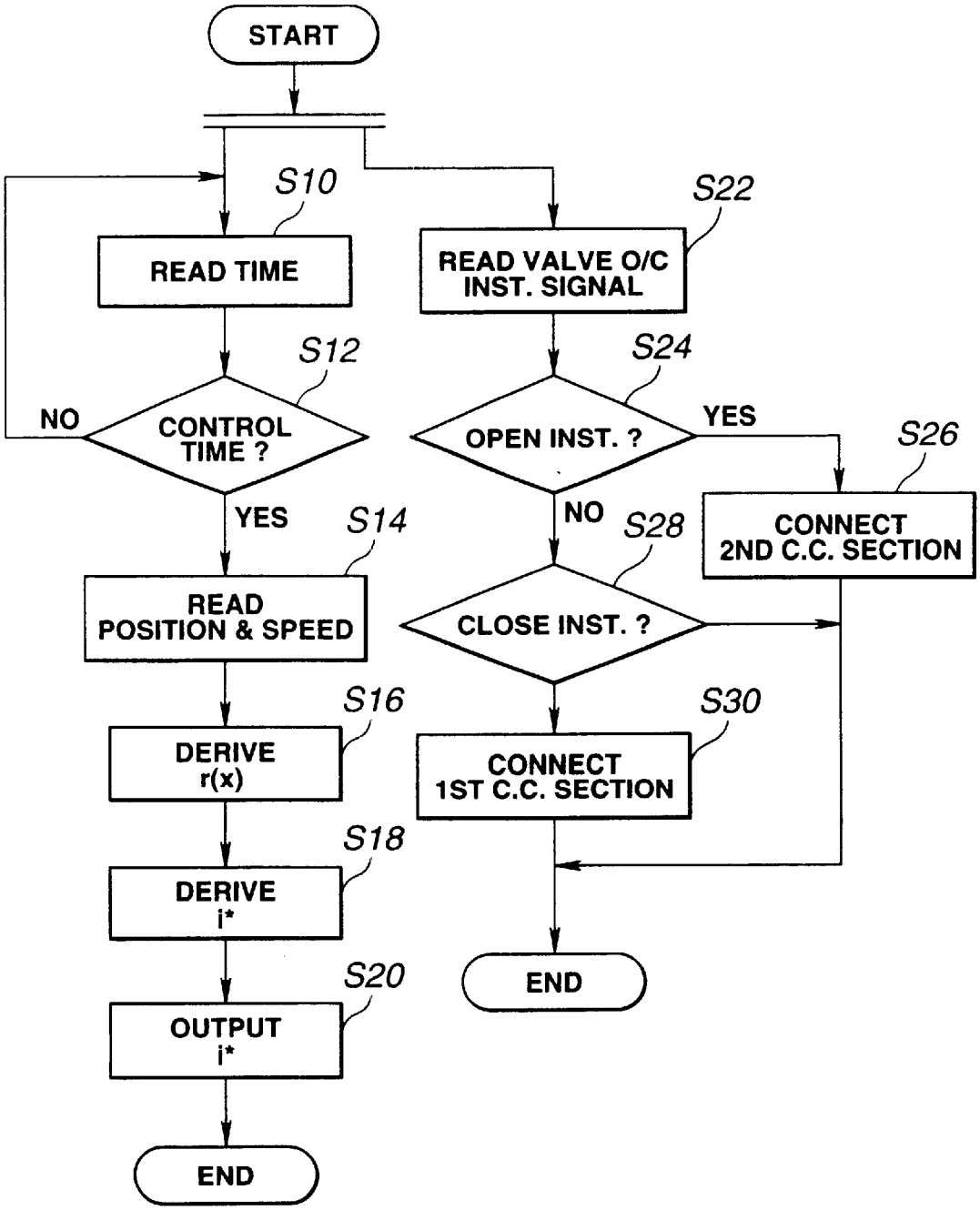
FIG. 4 is a flowchart showing programmed operation steps executed by a control unit employed in the first embodiment for controlling the electromagnetically actuated valve.

FIG. 4 is a flowchart showing programmed operation steps executed by the control unit 1 for controlling the electromagnetic actuator 250.

As shown, the flowchart has first and second flows which can be processed in a parallel manner. By the first flow, derivation and output of the target current are carried out and by the second flow, selection of the first or second current control section 9 or 10 is carried out.

That is, just at the moment the control starts, the controlled flow is split into the first flow from step S10 to step S20 and the second flow from step S22 to step S30. These first and second flows are processed in a parallel manner. However, if desired, the first flow may be processed after completion of procession of the second flow.

At step S10 in the first flow, a time is read from a timer installed in the control unit 1, and then at step S12, a judgment is carried out as to whether a control time has come or not. If NO, that is, when the control time has not come yet, the operation flow goes back to step S10, and if YES, that is, when the control time has come, the operation flow goes to step S14. At this step S14, the position and speed representing signals "x" and "y" from the position and speed sensors 3 and 2 are read. Then, if the position signal "x" is within a controlled range, the operation flow goes to step S16 where a target speed function "r(x)" is derived in the target speed deriving section 5, and then the operation flow goes to step S18 where a target current "i*" is derived in the target current deriving section 6. Then, the operation flow goes to step S20 where the target current "i*" is led to either one of the first and second current control sections 9 and 10 through the switch section 7. Then, the operation flow goes to end.

At step S22, a valve open/close instruction signal from the engine control unit 8 (ECU) is read, and then the operation flow goes to step S24. At this step S24, judgment is carried out as to whether the instruction signal is for opening the valve or not. If YES, that is, when the instruction signal is for opening the valve, the operation flow goes to step S26 where the switch section 7 functions to connect the target current deriving section 6 to the second current control section 10. Then the operation flow goes to end. If NO at step S24, that is, when the instruction signal is not for opening the valve, the operation flow goes to step S28. At this step S28, judgement is carried out as to whether the instruction signal is for closing the valve or not. If NO, that is, when the instruction signal is not for closing the valve, the operation flow goes to end. If YES at step S28, that is, when the instruction signal is for closing the valve, the operation flow goes to step S30 where the switch section 7 functions to connect the target current deriving section 6 to the first current control section 9. Then, the operation flow goes to end.

When, in an electromagnetic type valve actuating device, the gap "x" between the armature 57 and the valve opening or closing electromagnet 12 or 11 is large, energization of the electromagnet 12 or 11 produces only a small force directed to the armature 57 and thus when the gap "x" is large, the electric power applied to the electromagnet 12 or 11 is not effectively used. While, in the present invention, at the time when the gap "x" becomes "x1", that is, when "x=x1" is established due to a movement of the armature 57 to a position where the electromagnetic force produced by the electromagnet 12 or 11 is effectively applied to the armature 57, the speed control of the armature 57 starts, and when the armature 57 comes to a position where the electromagnetic force is not effectively applied to the armature 57, the electromagnet 12 or 11 is not energized. Accordingly, in the invention, the electric power is effectively used.

In the electromagnetic type valve actuating device, the spring-mass system thereof has a natural frequency. Since, in a conventional system, the force, such as the pressure in each cylinder of the engine and the friction force of the piston, applied to the intake valve 54 is forced to vary with passage of time due to aged deterioration of the engine, the time needed when the armature 57 moves from the vicinity of one electromagnet 11 or 12 that is deenergized to a certain position near the other electromagnet 12 or 11 where (viz., x=x1) the electromagnet force of the other electromagnet 12 or 11 starts to be effectively applied to the armature 57 is forced to change. However, in the present invention, the speed control of the armature 57 is appropriately carried out even in the above-mentioned environment.

Figure 5A:
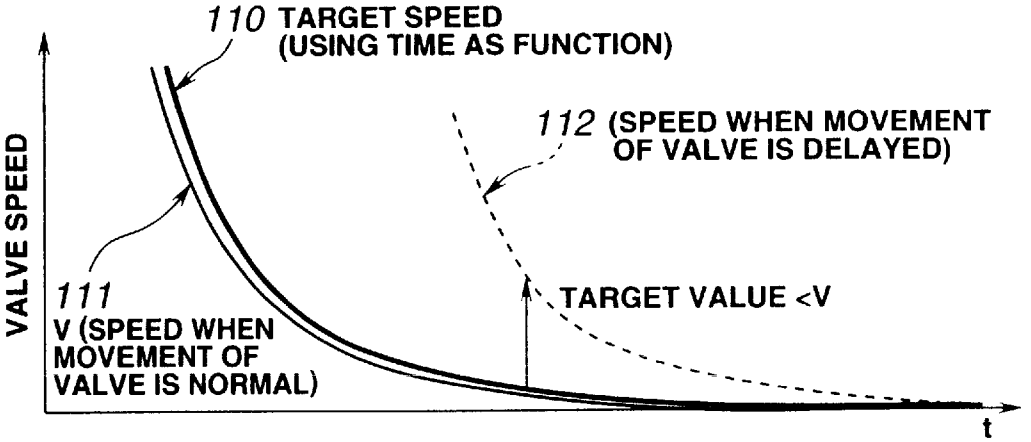
Figure 5B:
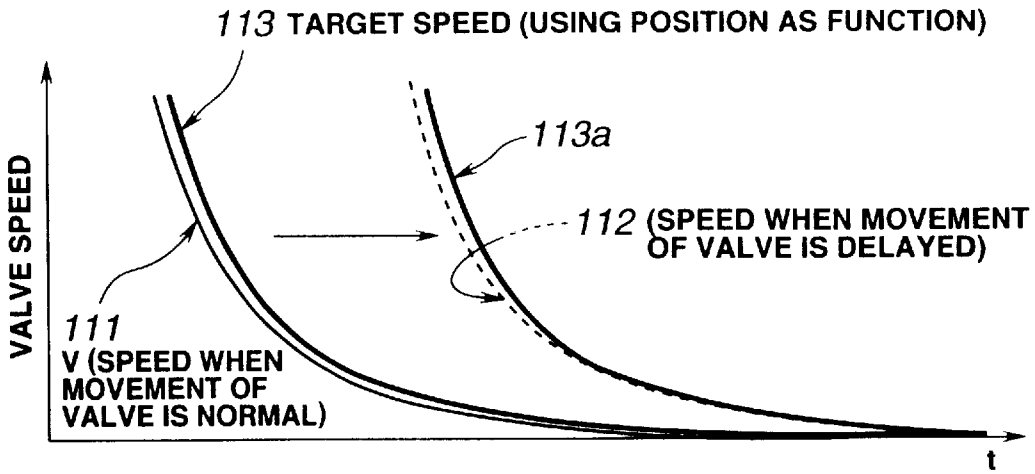

FIGS. 5A and 5B are graphs for explaining an advantage provided when the target speed of the armature is derived as a function of a position. That is, FIG. 5A is a graph of a target speed 110 that is derived using a time as a function, and FIG. 5B is a graph of a target speed 113 that is derived using a position as a function.

As is seen from these graphs, in the present invention, the target speed of the armature 57 (or the target current fed to the electromagnet 11 or 12 ) is derived using the armature position (viz., gap "x") as a function (viz., gap "x"). Thus, in the invention, the control of the intake valve can start with an accurate timing.

In an electromagnetically actuated valve, a delayed movement (more specifically, temporal stop) of the intake valve tends to occur due to a suddenly occurring abnormal combustion. As is seen from FIG. 5A, when the target speed 110 is derived using a time as a function based on a speed 111 of the armature that is provided when the valve operates normally, a speed 112 of the armature provided when a delayed movement of the valve occurs is obliged to exceed the target speed 110 after a certain time. Since the armature 57 can not be decelerated by the electromagnetic force, the speed control of the armature 57 is not carried out in such case.

As is seen from the graph of FIG. 5B, in the present invention, even when a delayed movement of the valve occurs, the target speed 113 can be derived using the position as a function. Accordingly, in considering the time region, as is seen from the dotted curve 112, the target speed 113 provided when the valve operates normally is generated as a speed 113*a* that is delayed in accordance with the delay of the armature. In this case, the speed control of the armature 57 is appropriately kept.

In the present invention, at the time "t1" when the speed control of the armature starts, the target speed is subjected to selection to be generally equal to the speed "v" of the armature 57. Accordingly, at the time when the control starts, a control error is substantially zero and thus at that time there is no need of consuming a marked electric current (viz., electromagnetic force) for matching the value "v" and the value "r(x)". Thus, the speed control of the armature 57 can be made by relatively small sized electric and electromagnetic circuits and a relatively low voltage power source.

If desired, for detecting a speed of the armature 57, the output from the position sensor 3 may be differentiated by time. In this case, the speed sensor 2 can be removed.

Figure 6:
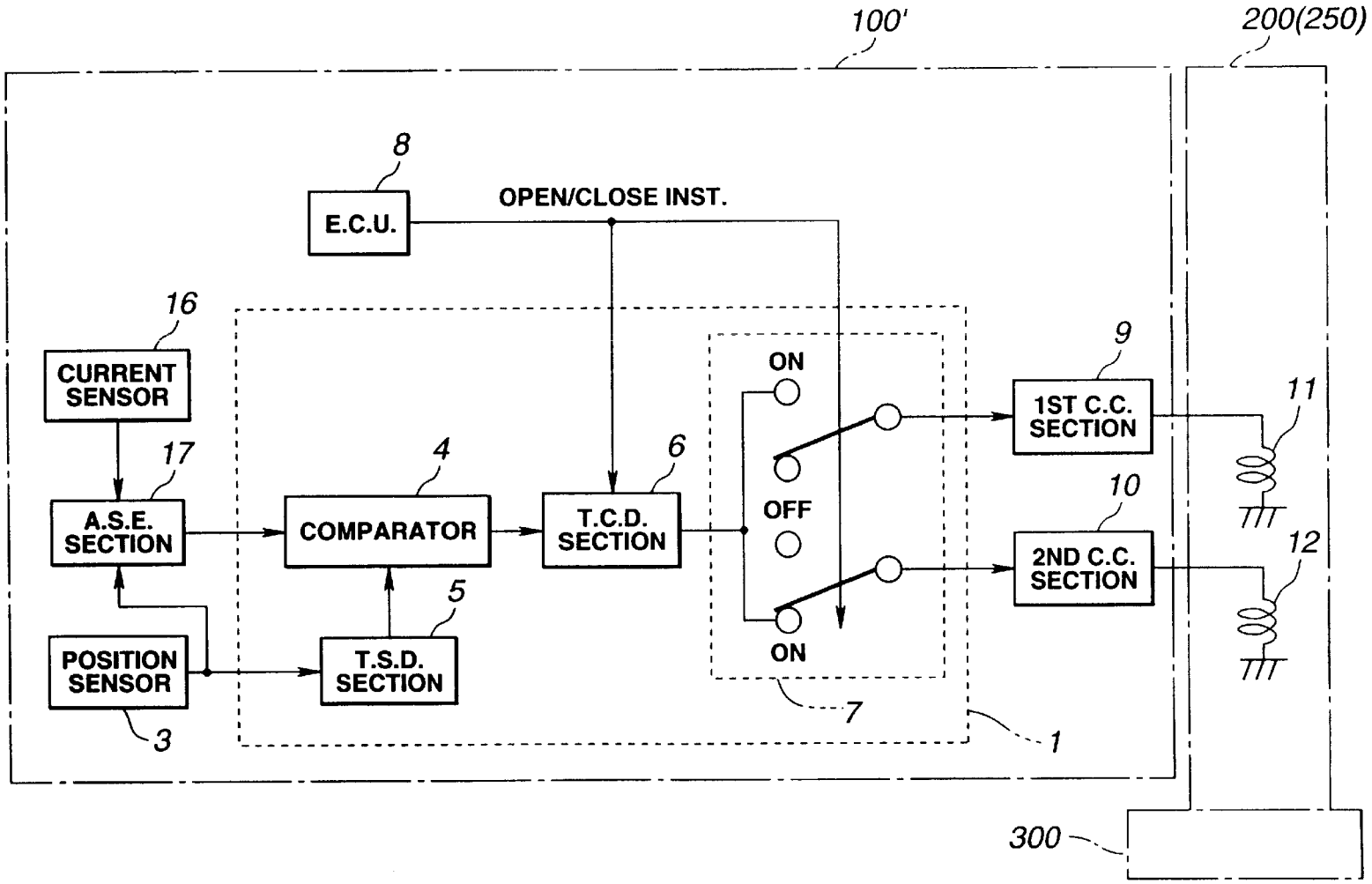
FIG. 6 is a view similar to FIG. 1, but showing a second embodiment of the present invention.

In the following, a control system 100' of a second embodiment of the present invention will be described with reference to FIG. 6.

In the control system 100' of the second embodiment, in place of the speed sensor 2 used in the above-mentioned first embodiment, a current sensor 16 and an armature speed estimating section 17 are employed. The current sensor 16 detects the current fed to the valve closing or opening electromagnet 11 or 12. Remaining parts are substantially the same as those of the first embodiment.

The current sensor 16 may be of a type which detects the output current from the first or second current control section 9 or 10 with an aid of a lower resistance resistor connected to the circuit 9 or 10 in series, or a type which converts a magnetic flux of the valve closing or opening electromagnet 11 or 12 into a current.

That is, in this second embodiment, based on both the current detected by the current sensor 16 and the armature position detected by the position sensor 3, the armature speed estimating section 17 estimates the speed of the armature 57.

If the mass of the armature 57 (more specifically, the mass of a moving body including the armature 57) is represented by "m", the spring constant of the moving body is represented by "k", the viscosity coefficient is represented by "c" and the magnetic force produced by the magnet 11 or 12, the movement of the moving body is represented by the following formulas:

$$dz/dt=Apz+Bp(F+\gamma) \tag{10}$$

$$x=Cpz \tag{11}$$

$$z=\begin{bmatrix} x \\ v \end{bmatrix},\quad Ap=\begin{bmatrix} 0 & 1 \\ -k/m & -c/m \end{bmatrix},\quad Bp=\begin{bmatrix} 0 \\ 1/m \end{bmatrix} \tag{12}$$

$$Cp=[10] \tag{13}$$

$$F=F(x,i) \tag{14}$$

It is to be noted that "F (x, i)" is a function previously determined by the shape and the material of the magnetic circuit and "γ" is an offset weighted component of the spring force. Based on these formulas (10) to (14), the armature speed estimating section 17 estimates the speed of the armature 57 by using the following formulas:

$$dy/dt=Ay+H(x-Cy)+BF(x,i) \tag{15}$$

$$ve=[001]y \tag{16}$$

$$A=\begin{bmatrix} 0 & 0 \\ Bp & Ap \end{bmatrix},\quad B=\begin{bmatrix} 0 \\ Bp \end{bmatrix},\quad C=[0\quad Cp] \tag{17}$$

It is to be noted that "ve" is an estimated value of the speed "v". The estimated speed "ve" of the armature is led to the comparator section 4 similar to the above-mentioned first embodiment. Subsequent operation is the same as that of the first embodiment, and thus description of the same will be omitted.

The entire contents of Japanese Patent Application P10-359591 (filed Dec. 17, 1998) are incorporated herein by reference.

Although the invention has been described above with reference to certain embodiments of the invention, the invention is not limited to the embodiments described above. Various modifications and variations of the embodiments described above will occur to those skilled in the art, in light of the above teachings.

What is claimed is:

1. In an electromagnetically actuated valve including an electromagnet, an armature member driven by said electromagnet and a valve driven by said armature member, said armature member and said valve being movable together to form a movable unit, a control system for controlling a velocity of said electromagnetically actuated valve, comprising:

a position detecting unit that detects a position of said movable unit relative to the electromagnet;

a speed detecting unit that detects an actual moving speed of said movable unit relative to the electromagnet;

a target speed deriving unit that derives a target speed of said movable unit based on the detected actual position of said movable unit;

a comparator unit that compares the speed detected by said speed detecting unit with the target speed derived by said target speed deriving unit to derive a deviation in speed; and a control section that, in accordance with the deviation in speed, controls the speed of said movable unit.

2. A control system as claimed in claim 1, in which said control section controls a current fed to said electromagnetic in accordance with the result of said comparison.

3. A control system as claimed in claim 1, in which said target speed of said movable unit is derived by using, as a function, a distance between said armature member and a reference point of an electromagnetic actuator that includes said electromagnet and said armature member.

4. The control system according to claim 1, wherein the moving speed of the movable unit is controlled to contact a valve closing electromagnet at a speed below a predetermined value.

5. The control system according to claim 1, wherein at a predetermined position, the movable unit is controlled to move by the control section according to a target speed function.

6. In an electromagnetically actuated valve including an electromagnet, an armature member driven by said electromagnet and a valve driven by said armature member, said armature member and said valve being movable together to constitute a movable unit, a control system for controlling said electromagnetically actuated valve, comprising:

a position detecting unit that detects a position of said movable unit;

a speed detecting unit that detects a moving speed of said movable unit;

a target speed deriving section that derives a target speed of said movable unit by processing the position of said movable unit;

a comparator section that compares the speed detected by said speed detecting unit with the target speed derived by said target speed deriving section;

a control section that, in accordance with the result of the comparison by the comparator section, controls said electromagnet, wherein said target speed of said moveable unit is derived by using, as a function, a distance between said armature member and a reference point of an electromagnetic actuator that includes said electromagnet and said armature member, wherein when said distance shows a first predetermined value, said target speed indicates a first function value that is substantially equal to the moving speed detected by said speed detecting unit, in which when said distance shows a second predetermined value that is substantially equal to the distance between said reference point and said electromagnet, said target speed indicates a second function value that is substantially zero, and in which when said distance shows a value other than said first and second predetermined values, said target speed indicates a value that is derived by subjecting said first and second function values to interpolation or extrapolation method.

7. A control system as claimed in claim 6, in which said second function value is zero.

8. A control system as claimed in claim 7, in which when said distance is smaller than said second predetermined value, said target speed is constantly zero.

9. In an electromagnetically actuated valve including an electromagnet, an armature member driven by said electromagnet and a valve driven by said armature member, said armature member and said valve being movable together to form a movable unit, a method for controlling a velocity of said electromagnetically actuated valve, comprising:

detecting a position of said movable unit relative to the electromagnet;

detecting an actual moving speed of said movable unit relative to the electromagnet;

deriving a target speed of said movable unit based on the detected actual position of said movable unit;

comparing the detected speed with the derived target speed to derive a deviation in speed; and controlling the speed of said movable unit in accordance with the deviation in speed.

10. A method as claimed in claim 9, in which the control of said electromagnet is carried out by controlling a current fed to said electromagnet.

11. A method as claimed in claim 9, wherein:

when a distance between said armature and a reference point of an electromagnetic actuator including said electromagnet and said valve corresponds to a first predetermined value, indicating a first function value of said target speed that is substantially equal to the detected moving speed; and when said distance corresponds to a second predetermined value that is substantially equal to the distance between said reference point and said electromagnet, indicating a second function value of said target speed that is substantially zero.

12. A method as claimed in claim 11, wherein:

when said distance corresponds to a value other than said first and second predetermined values, indicating a value that is derived by interpolating or extrapolating said first and second function values.

13. A method as claimed in claim 11, wherein the first predetermined value is greater than the second predetermined value.

14. The method according to claim 9, wherein the controlling the speed of said movable unit in accordance with the deviation in speed comprises controlling the speed of the movable unit to contact a valve closing electromagnet at a speed below a predetermined value.

15. The method according to claim 9, wherein the controlling the speed of said movable unit in accordance with the deviation in speed comprises controlling the movable unit to move according to a target speed function when the movable unit reaches a predetermined position.

* * * * *